United States Patent [19]

Kraft

[11] 4,249,649

[45] Feb. 10, 1981

[54] ESCALATOR HAVING YIELDABLE PRIMARY AND NON-YIELDABLE SECONDARY TRANSVERSE GUIDE POINTS ON ONE SIDE THEREOF

[75] Inventor: Joseph K. Kraft, Parsippany, N.J.

[73] Assignee: Westinghouse Electric Corp., Pittsburgh, Pa.

[21] Appl. No.: 13,870

[22] Filed: Feb. 22, 1979

[51] Int. Cl.[3] ..... B66B 9/12

[52] U.S. Cl. ..... 198/332; 198/838; 198/845

[58] Field of Search ..... 198/326–333, 198/838, 845; 104/1 A, 93, 106, 108–110; 16/91, 95 R, 102, 107; 308/18

[56] References Cited

U.S. PATENT DOCUMENTS

| | | | |
|---|---|---|---|
| 1,956,153 | 4/1934 | Lindquist et al. . | |
| 2,686,585 | 8/1954 | Margles et al. | 198/332 |
| 2,905,308 | 9/1959 | Hansen | 198/332 |
| 3,682,289 | 8/1972 | Kraft . | |
| 3,834,513 | 9/1974 | Miura et al. . | |
| 4,064,986 | 12/1977 | Bertovich | 198/326 |

FOREIGN PATENT DOCUMENTS

| | | | |
|---|---|---|---|
| 818161 | 8/1959 | United Kingdom | 198/332 |
| 1515070 | 6/1978 | United Kingdom | 198/332 |

*Primary Examiner*—Jeffrey V. Nase
*Attorney, Agent, or Firm*—D.R. Lackey

[57] ABSTRACT

An escalator including an endless belt and a plurality of steps attached thereto. The endless belt and steps are guided about a loop which includes load bearing and return runs for the steps, by guide wheels rotatably mounted on a common side of the endless belt, and a guide track. The guide wheels and guide track cooperatively define the first and second yieldable guide points, and first and second non-yieldable guide points, which function at different levels of side thrust forces on the endless belt.

4 Claims, 3 Drawing Figures

ESCALATOR HAVING YIELDABLE PRIMARY AND NON-YIELDABLE SECONDARY TRANSVERSE GUIDE POINTS ON ONE SIDE THEREOF

BACKGROUND OF THE INVENTION

1. Field of the Invention

The invention relates in general to escalators or moving stairways, and more specifically to new and improved arrangements for guiding passenger conveyors of this type.

2. Description of the Prior Art

An escalator includes an endless belt having a plurality of steps attached thereto. The endless belt and steps are driven through a load-bearing run which includes combplates at each end of the run, a balustrade on each side of the run for guiding a handrail, and skirt panels disposed immediately adjacent to each side of the run. It is desirable to provide a very small running clearance between the steps and the skirt panels. It is essential that the grooves in the step treads mesh properly with the teeth at the combplates. Thus, an escalator must be accurately guided laterally during its travel about the endless loop.

Many different guiding arrangements have been taught in the prior art. For example, escalators may be laterally guided by upstanding guide portions disposed on the tracks which support the main step wheels or rollers, one each side of the endless belt. The sides of the step wheels contact the guide portions on the tracks when a dimensional lateral limit is reached, in either lateral direction. The scuffing action between the sides of the wheels and the guiding portions of the tracks produces noise and wear, necessitating frequent lubrication in order to reduce the noise and wear to acceptable values.

Another prior art arrangement guides the steps from the back side of the skirts via a plurality of auxiliary wheels which bear against auxiliary guide angle members fastened to the skirts.

In both of these arrangements, the escalator is guided from both sides of the endless belt. Laterally guiding both sides of the endless belt, however, makes the positions of both the right- and lef-hand guides critical, requiring jigs and fixtures for accurately positioning the guide angle members on both sides of the escalator during manufacture. Further, the field installation and alignment of both guides is critical.

Thus, certain prior art arrangements disclose guiding an escalator from only one side of the endless belt, removing the criticality in the placement of the track on the other side of the escalator. For example, U.S. Pat. No. 4,064,986, which is assigned to the same assignee as the present application, discloses an escalator in which the guiding function is performed from one side of the escalator by guide wheels and a guide track, with the contacting portions of the guide wheels and the guide track being non-flat. An upthrust limit function is provided by guard wheels mounted coaxially with the guide wheels on the same side of the endless belt, and a guard track disposed on the opposite side of the rotational axis of the guide and guard wheels as the guide track. The guard wheels, in cooperation with the contoured guide wheels also function to limit lateral movement of the endless belt and connected steps.

While the structure taught by the U.S. Pat. No. 4,064,986 has many advantages over prior art escalator guiding arragenments, it would be desirable to be able to provide the advantages of this structure without the addition of guard wheels. The guard wheels taught in this patent protect the non-flat surfaces of the guide wheels from damage at transition sections, by supporting the weight of the conveyor across these sections on auxiliary tracks. The guard wheels also limit lateral movement of the endless belt and steps when subjected to severe side thrust forces, such as might be caused by the entrapment or wedging of an article between a step and a skirt panel. However, even with this limit on lateral movement, lateral movement may occur which allows a moving step to contact the adjacent stationary skirt panel, especially when the running clearance is at the low end of the dimensional range, which is typically 0.090 to 0.180 inch.

Thus, it would be desirable to provide a new and improved guiding arrangement for an escalator which guides from one side of the endless belt, which prevents damage to the guide wheels at transition points, and which limits side travel of the endless belt to a dimension less than the minimum normal running clearance dimension, while eliminating the additional guard wheels proposed by the hereinbefore mentioned U.S. Pat. No. 4,064,986.

SUMMARY OF THE INVENTION

Briefly, the present invention is a new and improved escalator, and improved lateral guiding means therefor, which simplifies the manufacture, installation and alignment of the main wheel track system, while providing lateral guidance of the steps through the entire track system and turn-arounds. The invention eliminates the need for guard wheels by utilizing guide wheels which provide sequentially initiated double guide functions. The initial or primary guiding function guides the endless belt and steps within about 0.015 inch of the desired tracking centerline. This primary guiding function is yieldable to abnormal side thrust forces, which initiates a second guiding function which is non-yieldable, and which limits the side travel to about 0.030 inch of the desired tracking centerline. Thus, even when the running clearance is at the low end of the typical range, i.e., about 0.090 inch, there is a safe margin or clearance between the steps and skirt panels which precludes contact therebetween.

The guide wheels have elastomeric, compressible tread portions which have a flat cross-sectional configuration at their outer periphery, and thus they will negotiate transition sections in the guide track without damage. The primary guiding function is provided between curved inner and outer edges of the elastomeric tread at the ends of the flat portion, which curved edges cooperate with curved portions of the guide rail. The guide wheels have metallic hub portions which cooperate with additional guiding portions of the guide rail to establish the secondary non-yieldable guide function.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENT

Figure 1:
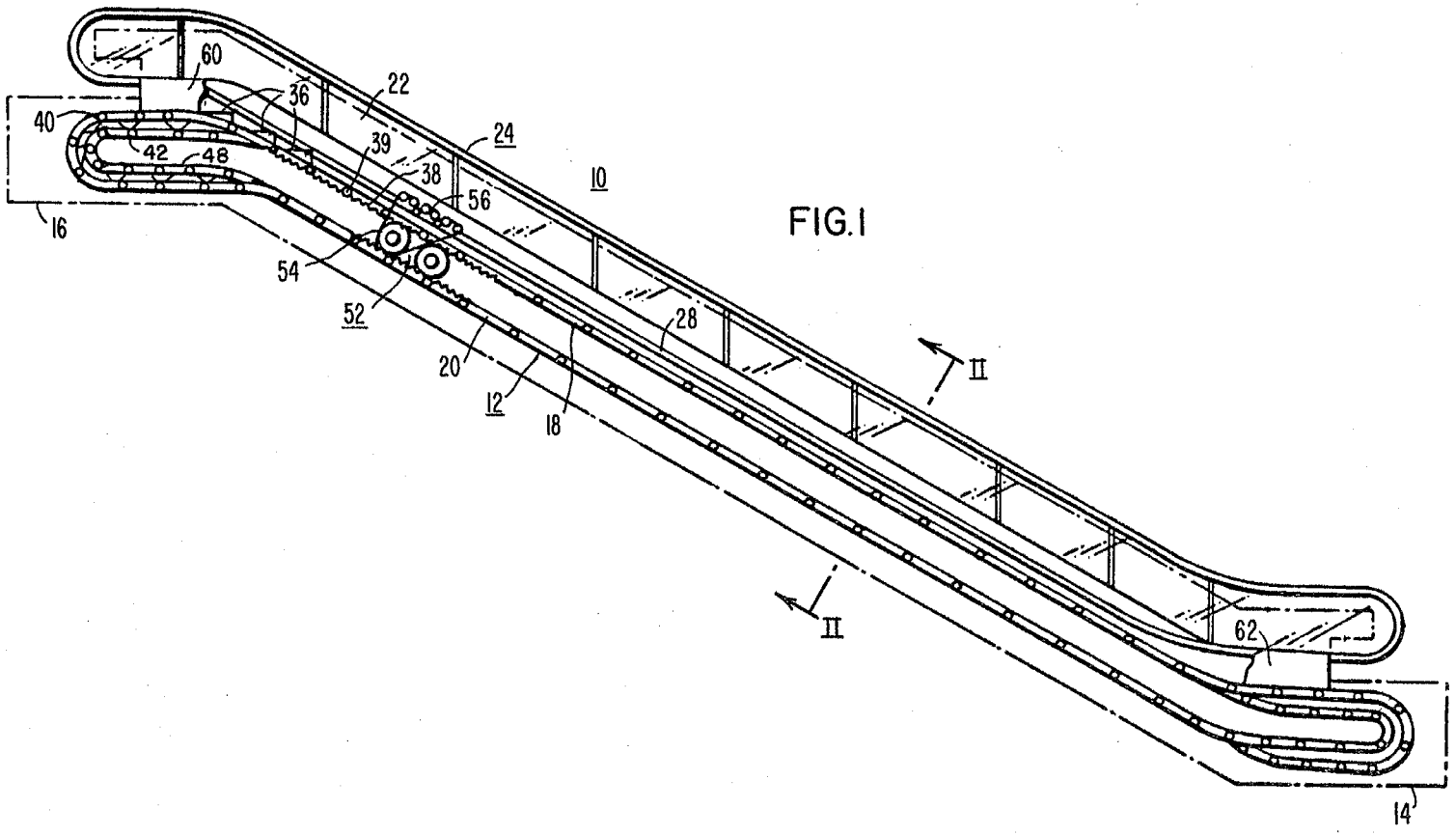
FIG. 1 is a schematic elevational view of an escalator which may be constructed according to the teachings of the invention.

Referring now to the drawings, and to FIG. 1 in particular, there is shown an escalator 10 of the type which may utilize the teachings of the invention. Escalator 10 employs an endless belt or conveyor 12 for transporting passengers between a first landing 14 and a second landing 16. The endless belt 12, which is supported by a truss structure, includes an upper load bearing run 18 upon which passengers stand while being transported between the landings, and a lower or return run 20.

A balustrade 22 is disposed above the conveyor 12 for guiding a continuous, flexible handrail 24.

Endless belt 12 includes a plurality of steps 36, only a few of which are shown in FIG. 1. The steps are each clamped to a step axle 37, shown in FIG. 2, and they move in a closed path, with the endless belt 12 being driven in a conventional manner, such as illustrated in U.S. Pat. No. 3,414,109, or the endless belt 12 may be driven by a modular drive arrangement as disclosed in U.S. Pat. No. 3,677,388, both of which are assigned to the same assignee as the present application. For purposes of example, the modular drive arrangement is shown in FIG. 1.

Figure 2:
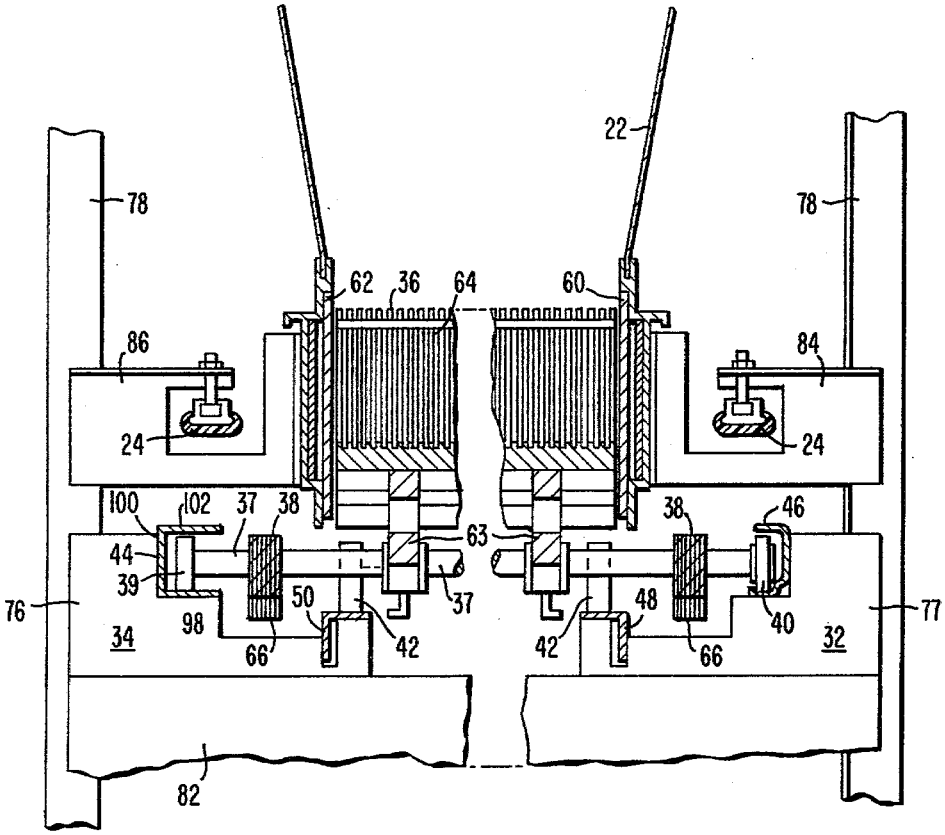
FIG. 2 is a sectional view, taken transverse to the direction of movement of the escalator along the line between arrows II—II in FIG. 1, illustrating a guiding arrangement constructed according to the teachings of the invention.

As disclosed in detail in U.S. Pat. No. 3,677,388, the endless belt 12 is formed of a plurality of toothed links 38, which are interconnected by the step axles 37, to which the steps 36 are connected. As illustrated in FIG. 2, which is a cross-sectional view of escalator 10 shown in FIG. 1, taken in the direction of and between arrows II—II, the steps are supported by guide and support rollers 40 and 39, respectively, at first and second opposite sides 32 and 34 of the endless belt 12, and by trailer rollers 42. The support and guide rollers 39 and 40 cooperate with support and guide tracks 44 and 46, respectively, and the trailer rollers 42 cooperate with trailer tracks 48 and 50, to guide the steps 36 in the endless path or loop.

The endless belt 12 and the connected steps 36 are driven by a modular drive unit 52, which includes sprocket wheels and a drive chain for engaging the toothed links 38. The modular drive unit 52 includes a handrail drive pulley 54 on each side of the endless belt, which drives the handrail drive units 56.

Skirt panels, also commonly called skirt boards or skirt guards, are disposed immediately adjacent the sides of the steps 36, such as skirt panels 60 and 62 disposed on sides 32 and 34, respectively, of the endless belt 12, with skirt 62 being shown in fragmentary form in FIG. 1. The skirt panels form substantially vertical walls adjacent to the sides of the load-bearing run. It is important to provide a small running clearance between the steps and the adjacent skirt panels, with the running clearance typically being in the range of 0.090 to 0.180 inch.

Referring now to FIG. 2 for a more detailed structural description of escalator 10, each step 36 is firmly clamped to a step axle 37. An improved step clamp arrangement which may be used is fully described in U.S. Pat. No. 3,789,972, which is assigned to the same assignee as the present application. Support rollers or wheels 39 are rotationally mounted on ends of the step axles 37 on the second side 34 of the endless belt 12, and the wheels 39 ride on tracks 44 on both the upper load-bearing run 18 and the return run 20 of the escalator 10.

Guide rollers 40 constructed according to the teachings of the invention, are rotationally mounted adjacent to the ends of the step axles 37 which are located on the firt side 32 of the endless belt 12, and these rollers or wheels ride in a guide track 46, which is also constructed according to the teachings of the invention.

The trailer wheels 42 are journaled to the step frame members 63, adjacent to the bottom of the riser portion 64 of the step, with the trailer wheels 42 being guided by L-shaped trailer tracks 48 and 50 on the first and second sides 32 and 34, respectively, of the endless belt 12.

The individual steps 36 are connected to the articulated endless belt 12 formed by rigid linkages 38 which are pivotally connected to the step axles 37 on either side of the steps 36. The linkages 38 are constructed of laminations of steel stampings having projections 66 which form teeth. The linkages have male and female connectors at opposite ends so that they cooperate with adjacent linkages to form a continuous rack. Drive units, such as drive unit 52, are spaced at intervals along the length of the stairway, as required by the rise, and these drive units mesh with the rack teeth on both the upper and return runs to impart a driving force to the escalator. The drive units and rack assemblies are more fully described in U.S. Pat. No. 3,677,388.

The tracks 44 and 46 for the support and guide rollers 39 and 40, respectively, and the tracks 50 and 48 for the trailer rollers 42, are precision welded to mounting plates 76 and 77, respectively. Truss chord members 78 are welded to the mounting plates. Skirt brackets 84 and 86, which may also be welded to the truss chord members 78, support skirt panels 60 and 62, respectively, at spaced locations along the load-bearing run. The truss chord members 78 are welded to lower and upper truss beams (not shown). Other truss chord members (not shown) are located at intervals along the length of the stairway. Diagonal truss members (not shown) give added strength to the supporting truss structure. The sides of the truss structure are rigidly connected by boxing members 82 which are welded to the mounting plates 76 and 77.

Figure 3:
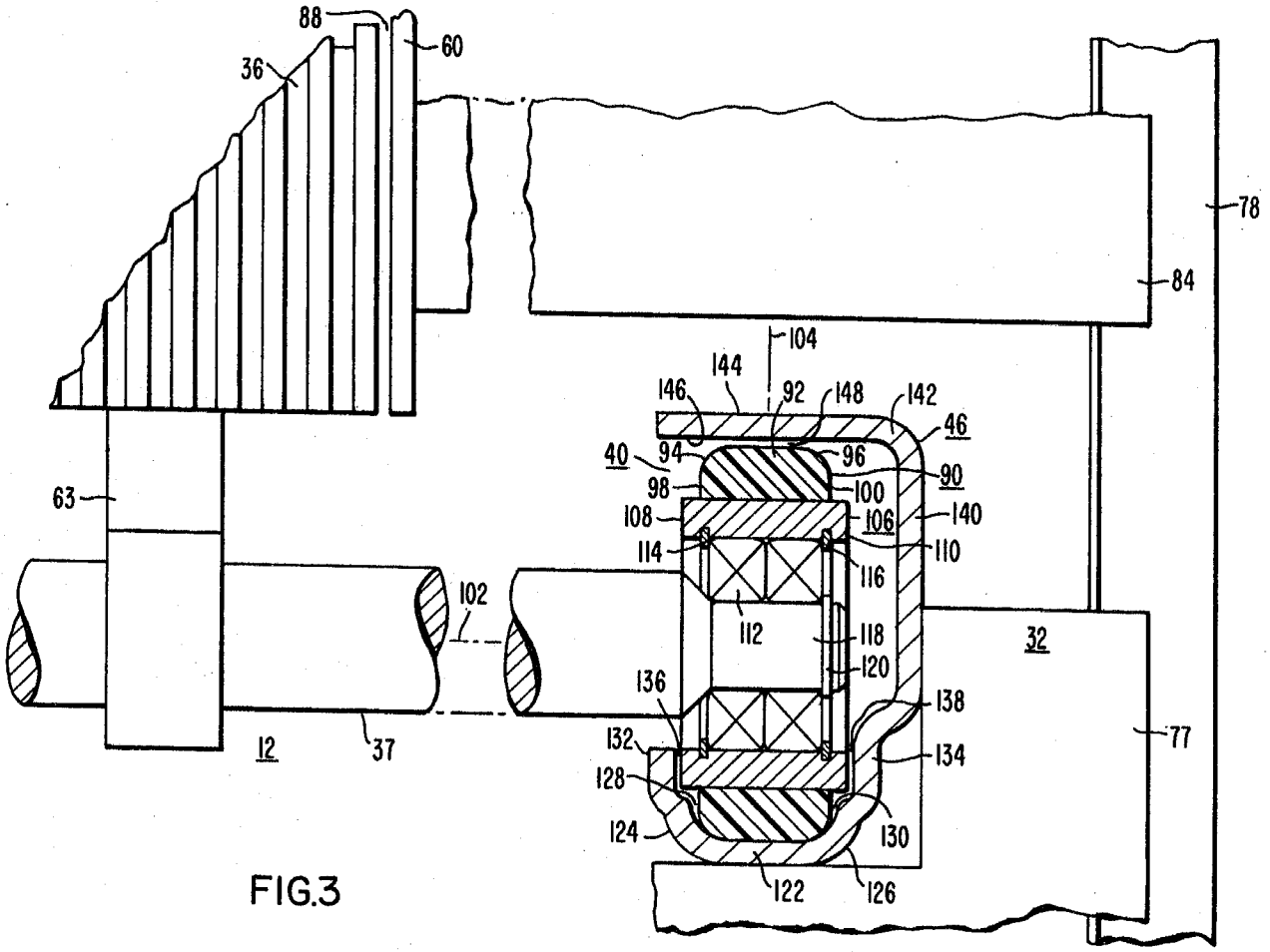
FIG. 3 is an enlarged, fragmentary, cross-sectional view of a portion of FIG. 2, which more clearly illustrates certain aspects of the invention, as well as relative dimensions of a guiding arrangement constructed according to the teachings of the invention.

FIG. 3 is an enlarged view of the guide wheel 40, guide track 46, step 36 and skirt panel 60 illustrated in FIG. 2, which more clearly illustrates the construction of the guide wheel 40 and guide track 46, and it highlights the important dimensional relationships between the guiding function and the running clearance 88 between the steps 36 and the adjacent skirt panel 60.

Guide wheel 40 includes a tread or tire portion 90 formed of a compressible or resilient material. An elastomeric material, such as polyurethane, is suitable. The tread portion 90 has a flat cross-sectional configuration at its outer periphery which defines a flat contact surface 92 for contacting the guide track 46. The flat portion 92 is relatively wide, at least 0.05 inch, in order to negotiate transition sections in the guide track without damage to the tread surface.

The flat portion 92 blends smoothly into inner and outer outwardly curved edges 94 and 96, respectively, which in turn blend smoothly into inner and outer side wall portions 98 and 100, respectively. The radii of the curved portions 94 and 96 may be 0.25 inch, for example. The side wall portions 98 and 100 may be perpendicular to the longitudinal axis 102 of the step axle 37, as illustrated, or it may slant outwardly from the centerline 104 of the guide wheel 40, as desired.

The tread 90 is securely attached to a metallic hub portion 106, which is preferably formed of steel, but aluminum or any other suitable metal may be used. Hub portion 106 is a tubular structure having first and second ends 108 and 110 which extend outwardly past the inner and outer edges 94 and 96, respectively, of the tread portion 90 of the guide wheel 40. The outer surface of the hub portion 106 is bonded to the tread portion 90, and its inner surface defines a cavity which receives a bearing assembly 112. Retainer rings 114 and 116 snap into cooperative internal grooves formed in the inner surface of the hub portion, to hold the bearing assembly 112 in the desired position.

Guide wheel 40 is mounted on an end 118 of step axle 37, and secured thereto with a retainer ring 120.

Guide track 46, which is preferably formed of steel, includes a substantially C-shaped lower portion which includes a flat bottom portion 122 which defines a flat support surface upon which the flat outer periphery 92 of the tread portion 90 rides.

Guide track 46 curves upwardly from the flat portion 122 to the define inner and outer side wall portions 124 and 126, respectively, which define inner and outer primary guide surfaces, respectively, immediately adjacent to, but slightly spaced from, the inner and outer edges 94 and 96, respectively, of tread portion 90. This slight spacing provides clearances 128 and 130 between the inner and outer edges 94 and 96 of tread 90 and the inner and outer primary guide surfaces of guide track portions 124 and 126, respectively, with each clearance being about 0.015 inch when the centerline 104 of the flat track portion 122 coincides with the centerline of guide wheel 40. The centerline 104 of the flat portion 122 of the guide rail 46 may be called the desired tracking centerline for the guide wheels 40 and the endless belt 12.

The inner and outer primary guiding surfaces of track portions 124 and 126 cooperate with the inner and outer edges 94 and 96, respectively, of the tread portion 90, to define first and second primary guide points. When endless belt 12 is subjected to side thrust forces in a direction which tends to increase the running clearance 88 between steps 36 and skirt panel 60, and to decrease the running clearance between the steps 36 and skirt panel 62, the first primary guiding point functions after only 0.015 inch side travel of the endless belt 12, to provide centering forces. In like manner, when the endless belt 12 is subjected to side thrust forces which move the endless belt in the opposite lateral direction, the second primary guide point functions to provide centering forces.

Since the first and second primary guide points include the compressible edges of the elastomeric treads 90, the first and second primary guide points are yieldable guide points. If the side thrust forces are greater than the opposing centering forces generated by the associated primary guide point, the tread will compress to allow the endless belt to move beyond the yieldable primary guide point.

Guide track 46 continues upwardly from the inner and outer portions 124 and 126, respectively, using appropriate bends or curves to prevent interference with the specific side wall configuration or angle utilized on the guide rollers, to provide substantially vertically oriented inner and outer portions 132 and 134, respectively, which define substantially vertically oriented inner and outer secondary guiding surfaces which are adjacent to, but spaced from, the first and second ends 108 and 110, respectively, of the tubular, metallic hub portion 106. The spacing provides clearances 136 and 138 between the first and second ends 108 and 110 of hub portion 106, and the inner and outer secondary guide surfaces of guide track portions 132 and 134, respectively, with each clearance being about 0.030 inch when the guide wheels 40 are on the desired tracking centerline 104.

The inner and outer secondary guide surfaces of track portions 132 and 134 cooperate with ends 108 and 110 to define first and second secondary guide points.

When the endless belt 12 is subjected to side thrust forces which overcome a primary, yieldable guide point, a secondary guide point functions after only a total of 0.030 inch side travel of the endless belt 12 from the desired tracking centerline, i.e., 0.015 inch travel to a primary guide point, and 0.015 inch additional travel to a secondary guide point. The secondary guide points are non-yielding, as the two surfaces which cooperate to define a secondary guide point are metallic.

In other words, when side thrust forces on the endless belt attempt to close the running clearance 88, for example, the second primary guide point functions after 0.015 inch travel from the desired tracking centerline 104, and the second secondary guide point functions after another 0.015 inch travel, to provide a positive limit on the side or lateral movement of the endless belt 12 and its connected steps 36. Thus, it is important to note that even when the running clearance 88 is on the low side of its typical 0.090 to 0.180 inch range, that the secondary guide points will prevent the steps 36 from coming any closer to the associated skirt panel 60 than 0.060 inch.

Guide track 46 terminates at the end of portion 132, but it continues upwardly from portion 134 to provide a substantially vertical side wall portion 140. Side wall portion 140 ends in a right angle bend 142 which interconnects side wall portion 140 with a portion 144 having an inner surface 146 which faces and is parallel with the support surface of the lower track portion 122. Surface 146 functions to limit the upper movement of the endless belt 12 via limiting the upward movement of the guide wheels 40. The spacing 148 between the flat top portion of the guide wheel 40 and surface 146 is about 0.090 inch. Thus, portion 144 of guide track 46 cooperates with the guide wheels 40 to provide an upthrust limiting function.

In summary, the "one-side" guide arrangement includes a combination of first and second primary yieldable guide points, and first and second secondary non-yieldable guide points. Under normal operating conditions, the primary guide points will provide the complete belt and step guidance function, guiding the belt within ±0.015 inch of the desired tracking centerline, without metal-to-metal contact, vibration, noise, or undue wear or any of the operating parts. Should an object become wedged between a step and a skirt panel, placing abnormally large side thrust forces on a step and the associated endless belt, a yieldable primary guide point is exceeded when the edge of the elastomeric tread of the guide wheels is compressed, and a non-yieldable secondary guide point functions to place a positive limit or stop on lateral travel of the endless belt in this direction. The secondary guide points limit side movement of endless belt and steps to ±0.030 inch from the desired tracking centerline. It is desirable to provide as small a running clearance as practical between the steps and adjacent skirt panels. Since the low end of a typical range is 0.090 inch, the secondary guide points will positively stop lateral movement of the steps before the steps can make contact with the skirt panels, preventing damage to the steps and skirt panels.

I claim as my invention:

1. An escalator, comprising:

an endless belt having first and second sides;

a plurality of steps attached to said endless belt;

means for driving said endless belt in a loop which includes load-bearing and return runs for said steps;

skirt means disposed to provide substantially vertical side walls adjacent to said steps, with a predetermined running clearance therebetween having a normal dimensional range which includes a normal minimum dimension;

a plurality of guide wheels rotatably mounted on the first side of said endless belt;

said guide wheels having a compressible tread portion;

said guide wheels having a substantially incompressible hub portion;

said tread portion having a flat cross-sectional configuration at its outer periphery, inner and outer side wall portions, and outwardly curved inner and outer edges which interconnect the outer periphery with the inner and outer side wall portions, respectively;

said hub portion being a tubular structure having first and second ends which extend outwardly past the inner and outer edges, respectively, of said tread portion;

a guide track on the first side of said endless belt;

said guide track having a flat support portion for supporting the flat outer periphery of the tread portion of said guide wheels, and inner and outer primary guide surfaces which extend upwardly from the flat support portion, said inner and outer primary guide surfaces being spaced to cooperate with the inner and outer edges, respectively, of the tread portion of said guide wheels, to define first and second primary guide points, respectively, which guide the endless belt within a first predetermined dimensional range from a desired tracking centerline when the endless belt is subjected to normal side thrust forces;

said guide track having portions which continue upwardly from both the inner and outer primary guide surfaces to define inner and outer secondary guide surfaces;

said inner and outer secondary guide surfaces being spaced to cooperate with the first and second ends, respectively, of said hub portion to define first and second secondary guide points, respectively;

said first and second secondary guide points becoming operative after abnormal side thrust forces compress an edge of said tread portion to force the endless belt beyond one of the first and second primary guide points, but before the endless belt and its connected steps move laterally by a dimension equal to the minimum normal running clearance, to provide positive limits on the lateral movement of said endless belt and steps which preclude contact between said steps and said skirt means on either side of said endless belt, while guiding said endless belt solely from the first side thereof.

2. The endless belt of claim 1 wherein the guide track includes an upthrust portion in spaced parallel relation with its flat support portion, said upthrust portion defining a surface which is spaced from the outer periphery of the tread portion by a predetermined dimension, when the guide wheels are seated on the flat support portion of the guide track.

3. The escalator of claim 1 wherein the minimum normal running clearance between the steps and skirt means is about 0.090 inch, the first predetermined dimensional range of the endless belt from a desired tracking centerline, defined by the first and second primary guide points is about ±0.015 inch, and wherein the first and second secondary guide points define a second dimensional range about ±0.030 inch.

4. The escalator of claim 1 including a plurality of support wheels mounted on the second side of the endless belt, and a support track mounted on the second side of the endless belt for cooperation therewith, said support track supporting said support wheels without lateral guiding action.

* * * * *